United States Patent [19]

Kanjo et al.

[11] Patent Number: 4,647,024

[45] Date of Patent: Mar. 3, 1987

[54] FRICTIONAL SHOCK-ABSORBING METHOD AND APPARATUS

[75] Inventors: Wajih Kanjo, Midlothian; William D. Wallace, Indian Head Park, both of Ill.

[73] Assignee: American Standard Inc., Chicago, Ill.

[21] Appl. No.: 680,702

[22] Filed: Dec. 12, 1984

[51] Int. Cl.[4] ..... B60G 15/04; B61G 9/02

[52] U.S. Cl. ..... 267/9 A; 213/28

[58] Field of Search ..... 267/9 A, 9 B, 9 C, 120, 267/138; 213/27, 28, 22, 40 R; 280/410

[56] References Cited

U.S. PATENT DOCUMENTS

| | | | |
|---|---|---|---|
| 759,481 | 5/1904 | Smortt | 213/28 |
| 1,221,428 | 4/1917 | Edahl | 213/28 |
| 1,894,717 | 1/1933 | Sproul | 267/9 A |
| 3,140,080 | 7/1964 | Rumsey | 213/40 R |
| 3,178,037 | 4/1965 | Kendall | 213/40 R |

*Primary Examiner*—Douglas C. Butler
*Assistant Examiner*—Robert J. Oberleitner
*Attorney, Agent, or Firm*—J. O. Ray, Jr.

[57] ABSTRACT

This invention teaches an improved high capacity frictional shock-absorbing assembly. The assembly comprises a housing with a first threaded member which is fitted therein for axial movement. A second threaded member is rotatably-fitted in the housing, but is restricted against axial movement. The first and second members are designed with compatible threaded surfaces for frictional engagement therebetween. A compression member is provided within the housing. The compression member is in engagement with the first threaded member to resist the axial movement of the first threaded member as it moves in a direction that will compress the such compression member.

46 Claims, 8 Drawing Figures

FRICTIONAL SHOCK-ABSORBING METHOD AND APPARATUS

BACKGROUND OF THE INVENTION

This invention relates, in general, to a high capacity shock-absorbing apparatus and, more particularly, to an improved apparatus for frictionally absorbing shock using a helicrl gear as the primary friction cushioning element.

Prior to the instant invention, apparatus for absorbing shock, such as, draft gears used in the railroading industry, have generally consisted of a primary friction cushioning element in tandem with a secondary cushioning element, the most common being a coil spring. Other secondary cushioning elements used include rubber pads, combination coil springs and rubber cores, and complex hydraulic units. Examples of friction draft gears, which include such secondary cushioning elements, can be found in the following U.S. Pat. No. 4,296,868 (FIG. 3) shows a friction draft gear with a coil spring arrangement widely used in the industry; U.S. Pat. No. 3,178,036 (FIG. 11) also shows a friction draft gear in combination with a coil spring and rubber core that is available in the industry; U.S. Pat. No. 3,368,698 (FIG. 1) shows a hydraulic cushioning element; and U.S. Pat. No. 2,317,445 (FIG. 3) shows a rubber pad as the secondary cushioning element. All of the above references are incorporated herein by reference. The primary friction cushioning elements used prior to the instant invention with all of the above-referenced secondary cushioning elements is best shown in FIG. 1 of U.S. Pat. No. 3,368,698 and FIG. 3 of U.S. Pat. No. 4,296,868. The friction assembly shown in these references comprises an outer stationary plate in abutting relationship with the inside of the housing wall, a movable plate in abutting relationship with the outer stationary plate, an inner tapered stationary plate in abutting relationship with the movable plate, a wedge shoe in abutting relationship with the tapered stationary plate, and a center wedge to engage the wedge shoe. With this type of primary friction cushioning element, a tremendous outward force is exerted on the housing walls during closure of the draft gear assembly. This force causes the housing walls to be in almost a continuous state of flexural stress.

As is well-known, particularly in the railroad art, draft gears have two major types of loads, buff and draft. Buff loading occurs during train makeup, train operation, train braking, and "in train action" to compensate for relative movement between cars. As is taught in the prior art, a friction cushioning element buff loading causes the coupler shank to exert a compressive force that is transmitted to the follower block which, in turn, distributes the load among the center wedge and the movable plates in the draft gear. Draft loading occurs primarily during locomotive tractive actions and "in train action" to compensate for relative movement between cars. Draft loading sets up tensile forces in the coupler shank that are transmitted through the coupler key and yoke to the housing end. This force is transmitted from the housing end through the housing walls, friction clutch mechanism, and follower block that is supported by the front lugs of the draft gear pocket of the car.

SUMMARY OF THE INVENTION

This invention teaches an improved high capacity frictional shock-absorbing assembly. The assembly comprises a housing with a first threaded member which is fitted therein for axial movement. A second threaded member is rotatably-fitted in the housing, but is restricted against axial movement. The first and second members are designed with compatible threaded surfaces for frictional engagement therebetween. A spring means is provided within the housing. The spring means is in engagement with the first threaded member to resist the axial movement of the first threaded member as it moves in a direction that will compress the spring means.

OBJECTS OF THE INVENTION

It is, therefore, the primary object of the invention to provide an improved assembly for frictional shock absorption that reduces the flexural forces on the housing walls of a draft gear assembly during repeated use.

Another object of the invention is to provide an improved assembly for frictional shock absorption wherein increased frictional cushioning is achieved.

Still another object of the invention is to provide an improved assembly for frictional shock absorption that will maintain the desired amount of frictional cushioning even in a worn condition.

Yet another object of the invention is to provide a frictional cushioning assembly having the above attributes while maintaining compatibility with other secondary cushioning elements.

Still yet another object of the invention is to provide an improved assembly for frictional shock absorption that is capable of providing the desired degree of cushioning during normal locomotive tractive actions.

These and various other objects and advantages of the invention will become more apparent to those skilled in the art of designing frictional shock-absorbing devices from the following detailed description, when such description is taken in conjunction with the attached drawings and the appended claims.

BRIEF DESCRIPTION OF THE PREFERRED AND ALTERNATIVE EMBODIMENTS

Now refer more particularly to the drawings wherein like numerals designate similar parts throughout the several views.

Figure 1:
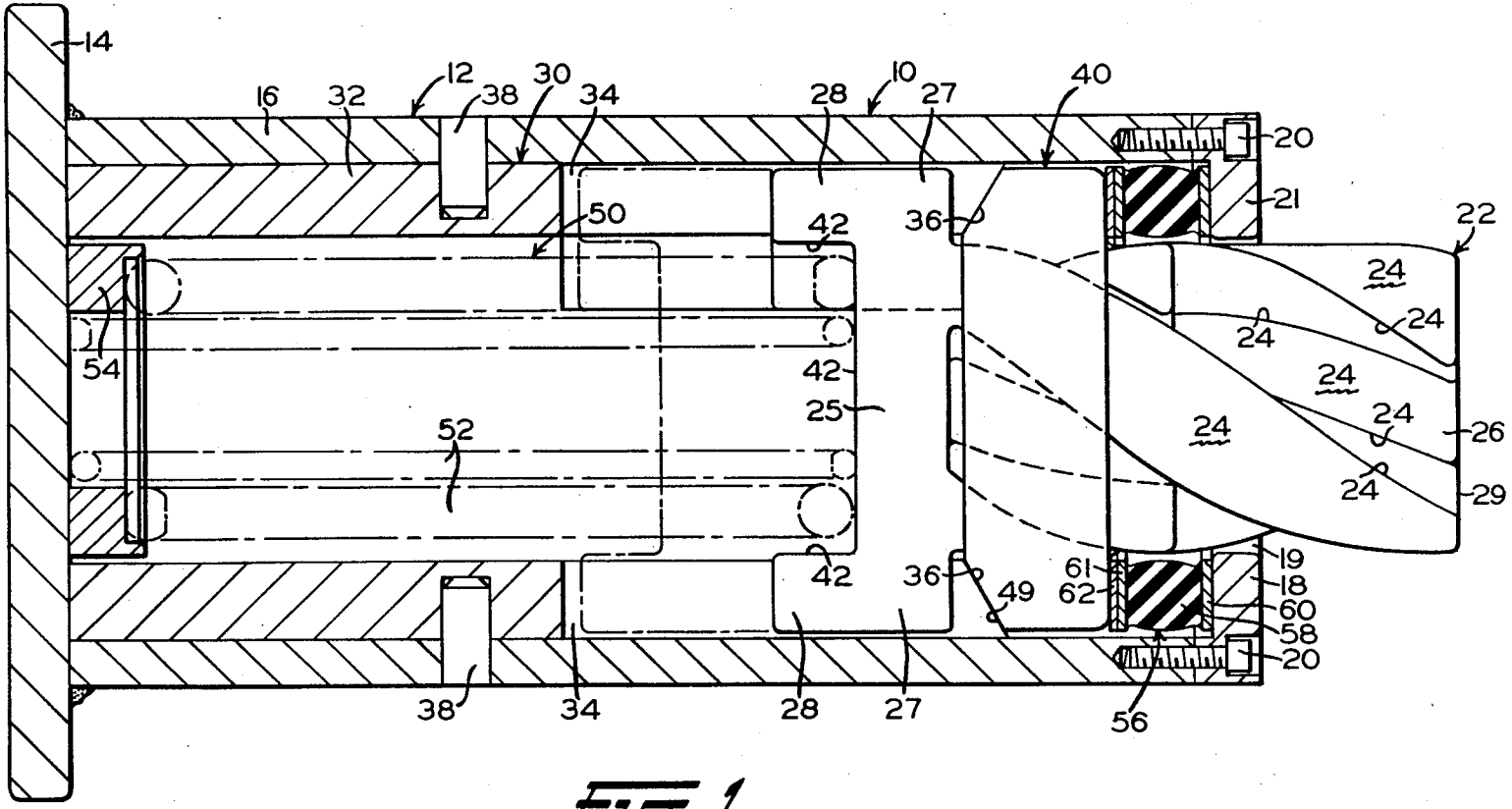
FIG. 1 is a longitudinal view that is partially in cross-section, showing a presently preferred embodiment of the invention with the extreme travel of a first threaded member shown in dashed line.

A presently preferred embodiment of the invention is fully shown in FIGS. 1 through 7. Although the instant invention is directed to an improved assembly for frictionally absorbing shock which may have numerous uses in industry, it will be described primarily as it would be used in the railroad industry as a draft gear. Therefore, as shown in FIG. 1, the draft gear assembly, generally designated 10, comprises a housing, generally designated 12. Housing 12 comprises a base plate 14 that will normally be shaped to retain the draft gear assembly 10 in the draft gear pocket (not shown) of a railroad car. A body member 16 is secured at one end thereof to base plate 14. If base plate 14 is secured to body member 16, such as by welding, and therefore not removable, then forward end plate 18 must be secured to the body member 16 in a removable manner. In this embodiment of the invention, body member 16 and forward end plate 18 are cylindrical. Forward end plate 18 is removably-secured to the body member 16 by cap screws 20, and the base plate 14 is welded to body member 16. With the forward end plate 18 being removable, it allows assembly and disassembly for repair of the device. A centrally-located aperture 19 is provided through forward end plate 18 to allow a portion of the first threaded member 22 to extend through aperture 19 for a predetermined distance. In one practice of the invention, we have found this distance can be between about 2.5 inches and about 4.0 inches, but we prefer that it be at least about 3 inches.

Figure 2:
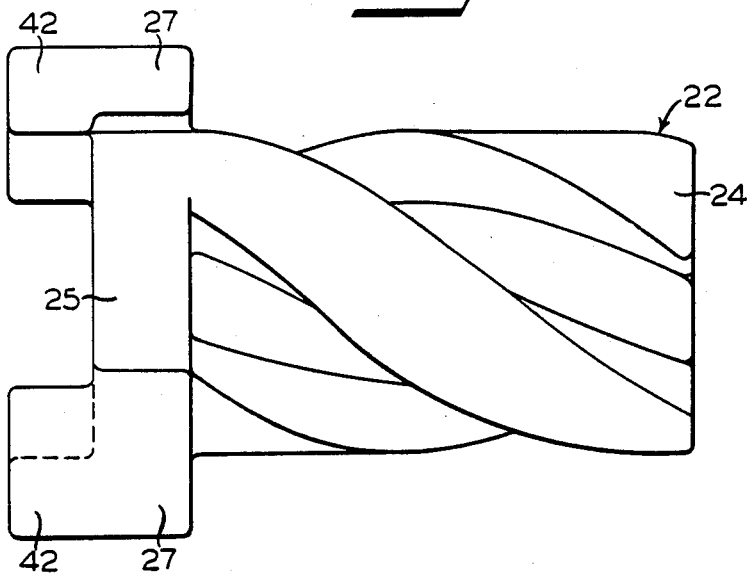
FIG. 2 is a side elevational view of the helical gear according to a presently preferred embodiment of the invention.
Figure 3:
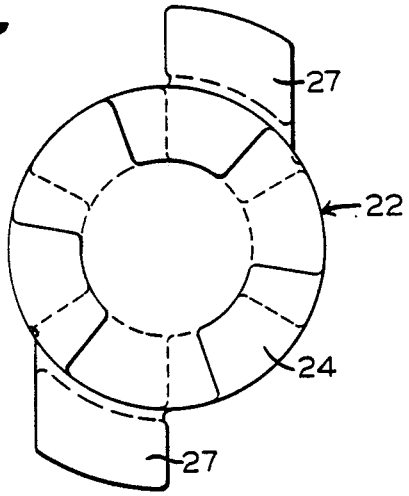
FIG. 3 is an end view of the helical gear shown in FIG. 2.

A first threaded member, generally designated 22, is fitted within the housing 12. According to the embodiment shown in FIGS. 1 and 8, first threaded member 22 is not rotatable. First threaded member 22 is, however, axially movable in housing 12. As best shown in FIGS. 2 and 3, first threaded member 22 consists of a helical shaft 26 secured on one end thereof to one side of a base 25. Helical shaft 26 includes a plurality of surfaces 24 on the outer periphery thereof. Base 25 and a portion of helical shaft 26 are positioned for axial movement in housing 12. First threaded member 22 also includes at least one member 27 positioned on at least one edge of the base 25 for frictional engagement with a means, generally designated 30, to restrict rotation of first threaded member 22. The helical shaft 26 of first threaded member 22 extends beyond the outer edge 21 of the forward end plate 18 for a predetermined distance. The member 27, for restricting rotation of the first threaded member 22 in this embodiment, includes at least one lug 28, and preferably two lugs 28, secured to an outer edge of base 25 for frictional engagement and cooperation with the means 30 which restricts rotation of first threaded member 22. In addition, means 30 in the presently contemplated preferred embodiment also allows first threaded member 22 to move in an axial direction.

Figure 6:
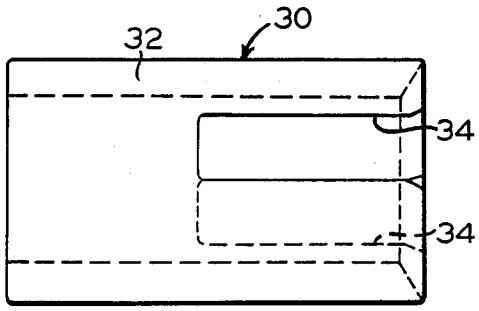
FIG. 6 is a longitudinal side view of a presently preferred stationary guide means used in the invention.
Figure 7:
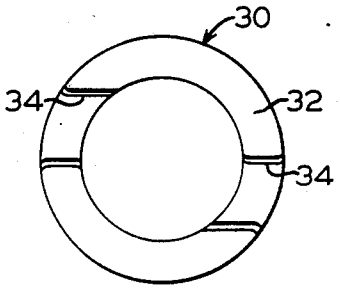
FIG. 7 is an end view of the stationary guide means shown in FIG. 6.
Figure 8:
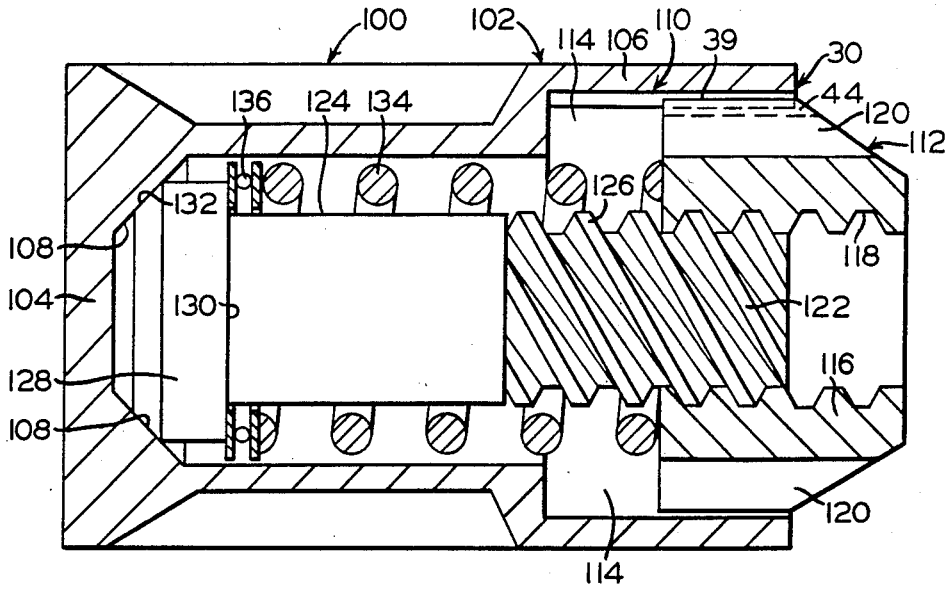
FIG. 8 is a longitudinal view that is partially in cross-section, showing an alternative embodiment of the invention with the first threaded member shown in its extreme extended position.
Figure 9:
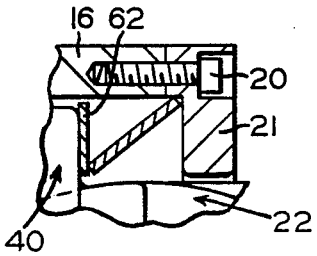
Figure 10:
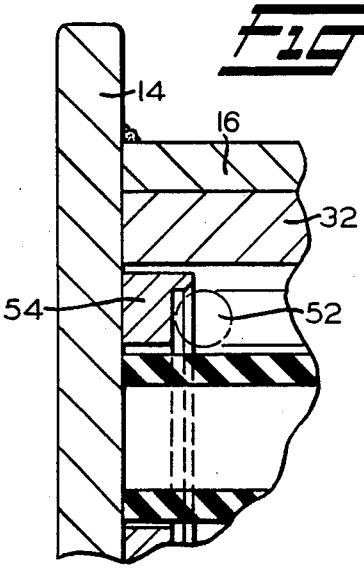

FIGS. 1, 6 and 7 provide a showing of means 30 to restrict rotation of first threaded member 22 and allows it to move in such axial direction. Means 30 may be cast as an integral part of housing 12 body member 16 and, depending on a particular user, this may be a preferred arrangement. In practice, this may be the least costly manufacturing method; and, if this were the case, with other things being equal, would be preferred. Nevertheless, means 30, as shown in a present practice of the invention, consists of a cylindrical body 32 having an outside diameter that is substantially the same size as the inside diameter of the body member 16 of the housing 12. Cylindrical body 32 of mean 30 includes at least one slot 34 for frictionally-engaging lug 28 of first threaded member 22 to resist rotation thereof, and to allow first threaded member 22 to move in an axial direction within slot 34 when an axial force is applied to end 29 of shaft 26. As an alternative embodiment, slot 34 may be notched into housing 12 body member 16. In the practice of the embodiment, shown in FIGS. 1, 6 and 7, cylindrical body 32 will have two slots 34 preferably spaced substantially equidistant about the central axis of cylindrical body 32. Cylindrical body 32 has at least one abutment surface 36 for frictionally-engaging a second threaded member, generally designated 40. The abutment surface 36 may extend outwardly from and be perpendicular to the inside longitudinal surface of body member 16 of housing 12. Although in the presently preferred embodiment of the invention, the abutment surface 36 is tapered within a predetermined range inwardly from the longitudinal surface of body member 16 and downwardly toward the base 14 of housing 12. The amount of such predetermined taper in this embodiment may be conveniently varied between about 15 degrees and about 45 degrees. If means 30 is formed as a separate piece, one convenient method of securing it to body member 16 of housing 12 would be by pins 38. As shown in FIG. 8, an alternative means 30, to restrict rotation of first threaded member 22 and allow it to move in an axial direction, comprises a longitudinal notch 44 in lug 28 with a matching longitudinal protuberance 39 in housing 12 body member 16.

Figure 4:
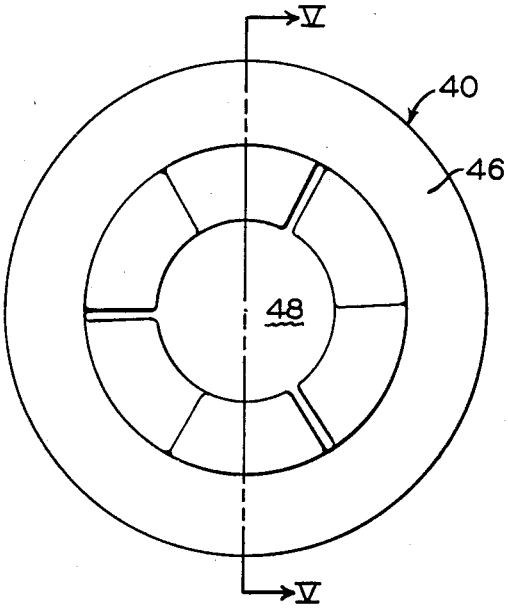
FIG. 4 is an end view of the rotatible nut used in a presently preferred embodiment of the invention.
Figure 5:
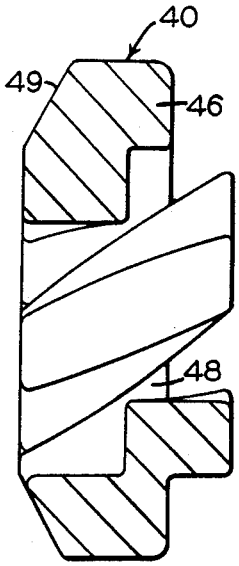
FIG. 5 is a sectional view taken along line V—V of FIG. 4.

Now refer to FIGS. 1, 4 and 5 for a showing of second threaded member 40 in the presently preferred practice of the instant invention. Second threaded member 40 is rotatably-fitted in the housing 12 body member 16 and is restricted against axial movement in one direction by abutment surface 36. Second threaded member 40 is, according to the embodiment shown, a nut 46 with a helical aperture 48 therethrough for mating frictional and rotational engagement with helical shaft 26 of first threaded member 22. The helical aperture 48 of nut 46 and the helical shaft 26 of first threaded member 22 must have compatible helical surfaces for frictional engagement therebetween. In a presently preferred arrangement of the invention, the helical aperture 48 surface of the nut 46 and the surface of the helical shaft 26 have a rise of about 2 inches for about each 53 degrees of rotation of the nut 46. Therefore, when helical shaft 26 extends outwardly through aperture 19 at least about three (3) inches such rotation of nut 46 will be about 79°. Nut 46 has an abutment surface 49 for frictional engagement with matching abutment surface 36 of cylindrical body 32. When using a tapered abutment surface 36 of body 32, the nut 46 abutment surface 49 will have a taper that corresponds to the taper of abutment surface 36 of cylindrical body 32, thereby allowing mating frictional engagement between nut 46 and body member 32.

As best shown in FIG. 1, a cushioning means, generally designated 50, is engageable with the bottom of the base 25 of first threaded member 22 to resist axial movement of first threaded member 22 and to absorb some of the forces generated by movement of first threaded member 22 in a direction that will cause cushioning means 50 to be compressed. The preferred cushioning means 50 is a spring cushioning means and includes a plurality of springs 52. The cushioning means 50 further includes a spring spacer 54 disposed within housing 12 between the base plate 14 and one end of at least the outermost spring 52 of the spring cushioning means 50. Another function of the spring spacer 54 is to maintain the cushioning means 50 in coaxial alignment during closure and release of the assembly 10. The opposed end of the spring cushioning means 50 abuts against the bottom of the base 25 of plunger 24. In a presently preferred practice of the invention, lugs 28 include a leg portion 42 which serves a dual function of cooperating with the spring spacer 54 to help contain the spring cushioning means 50 in coaxial alignment during closure and release of the draft gear assembly 10 and, in addition, it enables one to increase the frictional engaging surface area with the frictional surface area of slot 34 in cylindrical body 32, thereby adding flexibility to the capacity of the frictional shock-absorbing assembly.

As shown in FIG. 1, the improved high capacity frictional shock-absorbing assembly 10 utilizes, in the presently preferred embodiment, a means, generally designated 56, which may be a belleville washer (not shown) for urging the nut 46 into frictional engagement with abutment surface 36 of cylindrical body 32 of means 30 for resisting rotation of first threaded member 22. Means 56 also cooperates with abutment surface 36 to restrict axial movement of nut 46 in the opposite direction. Means 56, as shown, may also be an elastomeric constant-load spring member 58 secured between and to the plates 60 and 61 mounted within the forwardmost end of housing 12. In this arrangement, an antifriction bearing 62 is disposed between nut 46 and plate 61 of constant-load spring member 58. Antifriction bearing 62 may be, for example, a brass disc.

OPERATION

The frictional shock-absorbing assembly 10, as described above, operates in the following manner. When an axial force is applied to the end 29 of helical threaded shaft 26, during closure of the assembly 10, brought about by either a buffing or a draft shock, the first threaded member 22 moves inwardly toward the base plate 14 of the housing 12. Because first threaded member 22 is restrained against rotational movement, frictional forces are established between the helical threads of shaft 26 and the helical threads of aperture 48 of nut 46. With nut 46 being restricted against axial movement by abutment surface 36 and constant load spring 58, frictional forces are established between nut 46 abutment surface 49 and the adjacent abutment surface 36 as shaft 26 forces nut 46 to rotate. The friction established between abutment surface 49 of nut 46 and abutment surface 36 tries to rotate first threaded member 22 and therefore sets up additional frictional forces between lugs 28 of first threaded member 22 and slots 34 in the body 32 of the means 30 to resist rotation of first threaded member 22 as it is forced to move axially into housing 12. All of the abovedescribed frictional forces absorb energy and can be regulated over a wide range for particular applications. For example, additional lugs 28 and slots 34 or fewer lugs 28 and slots 24 can be provided to allow greater or less frictional surface area. Another expedient that can be controlled is the predetermined taper of abutment surface 36 and abutment surface 49 of nut 46, thereby providing more or less frictional surface area.

Further energy is absorbed by the compression of the cushioning means 50 as they are compressed while resisting the axial movement of first threaded member 22 into housing 12. Spring means 50, having a force greater than the preload means, returns the first threaded member 22 to its fully extended position wherein all actions reverse when the axial force urging first threaded member 22 inward is removed from the end 29 of shaft 26.

It is clear from the foregoing description of a presently preferred embodiment of the invention and the operation thereof, that the primary object of the invention to reduce the flexural forces on the housing walls, in addition to the other objects of the invention, are achieved.

Now refer to FIG. 8, wherein an alternative combination friction and coil spring draft gear assembly is shown. According to this embodiment of the invention, the draft gear assembly, generally designated 100, includes a housing, generally designated 102. Housing 102 includes a bottom base plate 104 and a cylindrical body member 106. Bottom base plate 104 has an abutment surface 108, the use of which will be hereinafter explained. Body member 106 of housing 102 includes a means, generally designated 110, to resist rotation of a first threaded member, generally designated 112. The means 110 for resisting rotation of first threaded member 112 includes a slot 114, and preferably a pair of slots 114, which will allow first threaded member 112 to move in an axial direction toward and away from bottom base plate 104 of housing 102. In one practice of the invention, the bottom base plate 104, abutment surface 108, body member 106, means 110 to resist the rotation of first threaded member 112, and slots 114 may be a one-piece casting if desired.

First threaded member 112 comprises a nut 116 having a threaded aperture 118 centrally-located therethrough. Nut 116 also includes at least one lug 120, and preferably two lugs 120, located equidistant from each other on nut 116 so that at least one surface of lugs 120 will frictionally-engage at least one surface along the side of slots 114 during axial movement of nut 116. The first threaded member 112 is fitted for axial movement within housing 102 at the forward end thereof. The preferred thread for aperture 118 of nut 116 is a fast thread helical design.

A second threaded member, generally designated 122, is rotatably-fitted within housing 102 for frictional engagement with abutment surface 108. Second threaded member 122 is restricted against axial movement within housing 102 on one side by abutment surface 108. Second threaded member 122 comprises a base plate 128 having a helical threaded shaft 126 attached at one end thereof to base plate 128. Helical threaded shaft 126 is positioned for frictional engagement with the helical threaded aperture 118 of nut 116. The base plate 128 of second threaded member 122 has a relative flat surface 130 on the side that the helical threaded shaft 126 is secured. Base plate 128 has an abutment surface 132 on the opposed side thereof for frictional engagement with the abutment surface 108 during rotation of second threaded member 122. In a presently contemplated preferred practice of this embodiment, abutment surface 108 is tapered outwardly from the inside longitudinal surface of body member 106 and downwardly toward base plate 104, and abutment surface 132 of base plate 128 is tapered upwardly from the base plate 104. The amount of taper is predetermined and has been found to be conveniently between about 15 degrees and about 45 degrees. Although it is not presently contemplated as a preferred practice, the tapered abutment surface 108 and corresponding taper 132 of plunger 124 may even be eliminated for some applications.

The assembly 100 also includes at least one coil spring 134 which serves a number of purposes. The spring 134 serves to absorb energy during operation by resisting axial movement of first threaded member 112 and also to preload plunger 124 to maintain it in frictional engagement with abutment surface 108. Spring 134, in addition, serves to limit or restrict axial movement of second threaded member 122 in one direction as does abutment surface 108 in the other direction. An antifriction bearing 136 is disposed within body member 106 between spring 134 and surface 130 of the base 128 of second threaded member 122 to minimize rotation of spring 134.

In operation of the embodiment shown in FIG. 8, when an axial force is applied to the end of the first threaded member 112, during closure of the assembly 100, brought about by either a buffing or a draft shock, the first threaded member 112 moves inwardly toward the base 104 of the housing 102. Since the first threaded member 112 is restricted against rotational movement by lugs 120 and slots 114, frictional forces are established between the threaded aperture 118 of nut 116 and the mating threaded shaft 126 of second threaded member 122. With second threaded member 122 being restricted against axial movement by abutment surface 108 of housing 102 and spring 134, frictional forces are established between base plate 128 abutment surface 132 and abutment surface 108 of housing 102 as the first threaded member 112 forces second threaded member 122 to rotate. The frictional resistance, established between abutment surface 132 of base plate 128 and abutment surface 108 of housing 102, tries to rotate first threaded member 112, and therefore establishes further frictional forces between at least one surface of lugs 120 and at least one surface of the sides of slots 114 which are resisting rotation of the first threaded member 112. These frictional forces are established when first threaded member 112 is forced to move axially into the housing 102. As with the presently preferred practice of the invention, all of the above-described frictional forces absorb energy during closure of the assembly 100. In addition, all of these forces can be varied in substantially the same manner as described supra. Also as before, additional energy is absorbed by the axial compression of spring 134 when spring 134 resists the axial movement of the first threaded member 112 into housing 102. The spring 134 serves to return the first threaded member 112 back to its fully extended position as soon as the axial force that had been urging first threaded member 112 inwardly has been either fully removed or has been reduced to some degree as would be the case with most "in train actions".

It can be seen from the above description of the alternative embodiment of the invention, along with the operation thereof, that it also provides a high capacity frictional shock-absorbing apparatus that achieves the primary object of the invention as well as the other objects of the invention.

While both the preferred and alternative embodiments have been described, it will be obvious to those skilled in the art that other modifications can be made without departing from the spirit and scope of the attached claims.

Having now described the invention, what we claim as new and desire to secure by Letters Patent is:

1. An improved high capacity draft gear assembly, said assembly comprising:

(a) a housing open at one end and closed at an opposite end thereof;

(b) a first threaded member having a first threaded portion positioned in said housing adjacent said open end and a second threaded portion extending outwardly from said open end, said first threaded member including an outer abptment surface axially opposite said closed end of said housing which is engageable by a follower block to transmit a radial force to said draft gear assembly and an inner abutment surface axially opposite said outer abutment surface, said first threaded member being axially movable within said housing;

(c) a second threaded member rotatably positioned in said housing substantially restricted against axial movement, said first and said second member having compatible threaded surfaces for frictional engagement therebetween; and (d) a spring means positioned in said closed end of said housing and engageable with said inner abutment surface of said first threaded member for storing energy during compression of said spring means by said first threaded member during closure of said draft gear assembly and thereafter releasing such stored energy to return said draft gear assembly to a non-compressed state.

2. A draft gear assembly, according to claim 1, wherein said first threaded member includes at least two frictional engaging surfaces.

3. A draft gear assembly, according to claim 2, wherein said second threaded member includes at least two frictional engaging surfaces.

4. A draft gear assembly, according to claim 3, wherein said draft gear assembly further includes at least one abutment surface positioned for frictionally engaging a matching surface on said second threaded member.

5. A draft gear assembly, according to claim 4, wherein said abutment surface is tapered outwardly and upwardly from a central axis.

6. A draft gear assembly, according to claim 5, wherein said taper is between about 15 degrees and about 45 degrees.

7. A draft gear assembly, according to claim 4, wherein said spring means urges said first threaded member to its extended position during release of said draft gear assembly.

8. A draft gear assembly, according to claim 4, wherein said draft gear assembly further includes a means for preloading said second threaded member thereby maintaining frictional engagement between said abutment surface and said second threaded member.

9. A draft gear assembly, according to claim 8, wherein said preloading means and said abutment surface substantially restrict said second threaded member against axial movement.

10. A draft gear assembly, according to claim 8, wherein said spring means includes a plurality of springs.

11. A draft gear assembly, according to claim 10, wherein said draft gear assembly further includes a means for maintaining.said spring means in axial alignment.

12. A draft gear assembly, according to claim 11, wherein said spring means includes at least one rubber spring in said plurality of springs.

13. A draft gear assembly, according to claim 7, wherein the threads of said first threaded member and said second threaded member are helical threads.

14. A draft gear assembly, according to claim 13, wherein said helical threads have a rise of about 2 inches for about each 53 degrees of relative movement between said first threaded member and said second threaded member.

15. A draft gear assembly, according to claim 14, wherein said second threaded member rotates about said first threaded member through an arc of at least about 79 degrees.

16. A draft gear assembly, according to claim 7, wherein said draft gear assembly includes a means positioned in said housing engageable with said first threaded member for substantially restricting said first threaded member against rotation.

17. A draft gear assembly, according to claim 16, wherein said means for restricting rotation of said first threaded means further includes a member for allowing said first threaded member to move axially within said housing.

18. A draft gear assembly, according to claim 17, wherein said means for allowing axial movement of said first threaded member is at least one slot for frictional engagement with a means positioned on said first threaded member for engaging said slot.

19. A draft gear assembly, according to claim 18, wherein said means positioned on said first threaded member for frictionally engaging said slot is at least one lug.

20. A draft gear assembly, according to claim 19, wherein said means for allowing axial movement of said first threaded member includes at least two slots and said first threaded member includes a like number of frictionally engaging lugs.

21. A draft gear assembly, according to claim 20, wherein said slots are spaced substantially equidistant from each other and said lugs are similarly spaced.

22. A draft gear assembly, according to claim 17, wherein said means for restricting rotation and for allowing axial movement within said housing of said first threaded member is an integral part of said housing.

23. A draft gear assembly, according to claim 8, wherein said means for preloading said second threaded member is a belleville washer.

24. A draft gear assembly, according to claim 8, wherein said means for preloading said second threaded member comprises:

(a) a constant-load spring fitted within said housing between said second threaded member and the forward end of said housing; and (b) an antifriction bearing disposed within said housing and in engagement with each of said second threaded member and said constant-load spring.

25. A draft gear assembly, according to claim 24, wherein said constant-load spring is an elastomeric material.

26. A draft gear assembly, according to claim 8, wherein said spring means serves as said preloading means.

27. A draft gear assembly, according to claim 26, wherein said draft gear assembly further includes an antifriction bearing between said second threaded member and said spring means.

28. A draft gear assembly, according to claim 19, wherein said first threaded member is a plunger, said plunger comprising:

(a) a base positioned for axial movement within said housing;

(b) at least one lug positioned on said base for frictionally engaging said slot; and (c) a helical shaft integral with said base for frictionally engaging said second threaded member, said helical shaft extending beyond the forward end of said housing for at least about 3 inches.

29. A draft gear assembly, according to claim 28, wherein said second threaded member is a nut, said nut including a helical aperture therethrough for mating frictional engagement with said helical shaft on said plunger.

30. A draft gear assembly, according to claim 29, wherein said means to maintain said spring means in axial alignment includes at least one lug partially encompassing said spring means.

31. A draft gear assembly, according to claim 17, wherein said means for resisting rotation and for allowing axial movement within said housing of said first threaded member is a longitudinal slot on at least one of said housing and said first threaded member and a mating longitudinal protuberance on at least one of the other of said housing and said first threaded member.

32. A draft gear assembly, according to claim 17, wherein said means for resisting rotation and for allowing axial movement within said housing of said first threaded member further includes said abutment surface for mating frictional engagement with said second threaded member.

33. A draft gear assembly, according to claim 19, wherein said first threaded member is a nut, said nut including a centrally-located helical aperture therethrough.

34. A draft gear assembly, according to claim 33, wherein said second threaded member is a plunger, said plunger comprising:

(a) a base member, said base member including a frictionally engaging surface for engagement with said abutment surface; and (b) a shaft integral with said base, said shaft having a helical threaded portion for frictional engagement with said helical operative of said nut.

35. A draft gear assembly, according to claim 34, wherein said abutment surface is positioned within said housing adjacent a base thereof.

36. A draft gear assembly, according to claim 34, wherein said spring means is coaxial with said shaft of said plunger.

37. A draft gear assembly, according to claim 36, wherein said draft gear assembly includes an antifriction bearing positioned between said base and said spring means to minimize winding of said spring during rotation of said base.

38. A draft gear assembly, according to claim 37, wherein said spring means is also a means for preloading said plunger to maintain frictional engagement between said base and said abutment surface.

39. A method of dissipating energy on a draft gear assembly, said method comprising the steps of:

(a) positioning a first threaded portion of a first threaded member in a housing which is open at one end and closed at an opposite end, said first threaded portion including a first abutment surface facing said closed end of said housing, said first threaded member having a second threaded portion extending outwardly from said open end of said housing, said second threaded portion having a second abutment surface axially opposite said first abutment surface which is engageable with a follower member that exerts an axial force on said first threaded member;

(b) displacing said first threaded member in an axial direction in response to one of an axial buff and draft force applied to said first threaded member by said follower member;

(c) transferring a portion of said force to a second threaded member threadingly engaging said first threaded member;

(d) restraining one of said first and said second threaded members against rotation;

(e) limiting the axial movement of the other of said first and said second threaded members thereby imparting rotation to said other of said first and said second threaded members through said threading engagement;

(f) frictionally resisting rotation of said other of said first and said second threaded members with a third abutment surface thereby absorbing a first portion of said energy from said buffing and draft forces;

(g) storing a second portion of said energy during said axial displacement of said first threaded member against a compression means caged between said first abutment surface and said closed end of said housing; and (h) releasing said portion of stored energy in said compression means to return said draft gear assembly to an uncompressed position after said axial buff and draft forces are reduced.

40. A draft gear assembly energy dissipation method, according to claim 39, wherein said method includes the additional step of dissipating a third portion of said energy in said threaded engaging portions of said first threaded member and said second threaded member during said axial displacement of said first threaded member.

41. A draft gear assembly energy dissipation method, according to claim 40, wherein said method includes the additional step of controlling the amount of said third portion of energy dissipated by varying the length of the mating surfaces of said threaded portions of said first threaded and said second threaded member.

42. A draft gear assembly energy dissipation method, according to claim 39, wherein said method includes the additional steps of:

(a) abutting a friction surface formed on said first threaded member against a mating friction surface; and (b) dissipating a fourth portion of said energy in said friction surfaces during said axial displacement of said first threaded member.

43. A draft gear assembly energy dissipation method, according to claim 42, wherein said method includes the additional step of controlling the amount of said fourth portion of energy dissipated by varying the surface area of said friction surfaces.

44. A draft gear assembly energy dissipation method, according to claim 39, wherein said method includes the additional step of preloading said second threaded member to thereby increase the amount of said first portion of said energy dissipated.

45. A draft gear assembly energy dissipation method, according to claim 44, wherein said method includes the additional step of controlling the amount of said first portion of energy dissipated by varying the surface area of said friction surfaces.

46. A draft gear assembly energy dissipation method, according to claim 39, wherein the amount of said second portion of energy stored in step (g) is an amount at least sufficient to move said first threaded member in step (h).

* * * * *

UNITED STATES PATENT AND TRADEMARK OFFICE

CERTIFICATE OF CORRECTION

PATENT NO. : 4,647,024

DATED : March 3, 1987

INVENTOR(S) : Wajih Kanjo et al

It is certified that error appears in the above-identified patent and that said Letters Patent are hereby corrected as shown below:

Column 8, Claim 1, clause (b), line 11, delete "abptment" and insert --abutment--

Signed and Sealed this

Seventeenth Day of November, 1987

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,647,024

DATED : March 3, 1987

INVENTOR(S) : Wajih Kanjo et al

It is certified that error appears in the above-identified patent and that said Letters Patent are hereby corrected as shown below:

Column 9, line 23, delete "means" and insert --member-- same line, delete "member" and insert --means--

Signed and Sealed this

Tenth Day of May, 1988

*Attest:*

*Attesting Officer*

DONALD J. QUIGG

*Commissioner of Patents and Trademarks*